US011348568B2

(12) United States Patent
Schoonraad et al.

(10) Patent No.: US 11,348,568 B2
(45) Date of Patent: May 31, 2022

(54) REACTIVE SILENT SPEAKER DEVICE FOR SIMULATING HARMONIC NONLINEARITIES OF A LOUDSPEAKER

(71) Applicant: AMP Devices, LLC, North Hollywood, CA (US)

(72) Inventors: Robert Andrew Schoonraad, North Hollywood, CA (US); Ronald Girgis, North Hollywood, CA (US)

(73) Assignee: AMP Devices, LLC, North Hollywood, CA (US)

( * ) Notice: Subject to any disclaimer, the term of this patent is extended or adjusted under 35 U.S.C. 154(b) by 56 days.

(21) Appl. No.: 17/006,434

(22) Filed: Aug. 28, 2020

(65) Prior Publication Data

US 2022/0068254 A1 Mar. 3, 2022

(51) Int. Cl.
*G10K 15/04* (2006.01)
*H04R 21/00* (2006.01)
(Continued)

(52) U.S. Cl.
CPC ..... *G10K 15/04* (2013.01); *H01F 27/40* (2013.01); *H04R 21/00* (2013.01); *H01C 3/20* (2013.01); *H01F 17/04* (2013.01)

(58) Field of Classification Search
CPC ..... H01C 3/20; G10K 15/04; H01F 27/40; H01F 17/04; H04R 21/00
See application file for complete search history.

(56) References Cited

U.S. PATENT DOCUMENTS 2,748,357 A * 5/1956 Garcia ..... H01F 21/06 336/134
4,622,660 A * 11/1986 Cowans ..... H03G 5/165 369/174

(Continued)

FOREIGN PATENT DOCUMENTS

CN 107103973 A * 8/2017
GB 2446613 A * 8/2008 ..... H01C 1/082
JP S5880809 A * 5/1983

OTHER PUBLICATIONS

Multicomp, Wirewound Chip Inductor Ferrite (Year: 2019).*

(Continued)

*Primary Examiner* — Matthew A Eason
*Assistant Examiner* — Kuassi A Ganmavo
(74) *Attorney, Agent, or Firm* — Ansari Katiraei LLP; Arman Katiraei; Sadiq Ansari

(57) ABSTRACT

Disclosed is a device for introducing loudspeaker harmonic nonlinearities to a signal without outputting the signal as audio or sound through a loudspeaker and recording the output audio or sound. The device includes a resistive element and an inductive element. The resistive element includes a hollow core and a first wire wound around the hollow core in a first direction. The inductive element is inserted within the hollow core of the resistive element, and includes a metal-based core and a second wire wound around the metal-based core in an opposite second direction. A signal or current is first passed through the inductive element, creating electromagnetic distortion between the resistive element and the inductive element that simulates inductance of the loudspeaker voice-coil. The electromagnetic distortion alters the signal by introducing harmonic nonlinearities into the signal.

20 Claims, 6 Drawing Sheets

(51) Int. Cl.

| | |
|---|---|
| ***H01F 27/40*** | (2006.01) |
| ***H01C 3/20*** | (2006.01) |
| ***H01F 17/04*** | (2006.01) |

(56) References Cited

U.S. PATENT DOCUMENTS

| | | | | |
|---|---|---|---|---|
| 7,024,007 | B1 * | 4/2006 | Charbonnaux | H04R 3/12 381/62 |
| 2006/0251275 | A1 * | 11/2006 | Ackley | G10H 3/186 381/118 |
| 2009/0318032 | A1 * | 12/2009 | Eguchi | H02H 3/12 439/660 |
| 2012/0139685 | A1 * | 6/2012 | Hansen | H01F 17/04 336/105 |
| 2020/0153392 | A1 * | 5/2020 | Miyoshi | H03F 3/68 |

OTHER PUBLICATIONS

Riedon, Why is a wirewound resistor not a wirewound inductor (Year: 2017).*

Price, All about . . . Attenuators (Year: 2016).*

Neunaber, Reactive loads for guitar amps (Year: 2018).*

Elliott, Dummy Load for amplifer testing (Year: 2009).*

Harry Kolbe, Silent Speaker (Year: 1993).*

Dobrucki et al, "Modeling of the nonlinear distortion in electrodynamic loudspeakers caused by the voice-coil inductance", Nov. 17, 2010, 10ème Congrès Français d'Acoustique, Apr. 2010, Lyon, France, hal-00537203—https://hal.archives-ouvertes.fr/hal-00537203.

Andrzej Dobrucki, "Nonlinear Distortions in Electroacoustic Devices", Feb. 10, 2011, Wroclaw University of Technology Institute of Telecommunications Teleinformatics and Acoustics, Chair of Acoustics, Wybrzeze Wyspianskiego 27, 50-370 Wroclaw, Poland.

Eas Meril¯ Ainen, "Comparative Measurements on Loudspeaker Distortion: Current vs. Voltage Control", Apr. 24, 2016, Eerikinkallio 4 A 8, Fl-02400 Kirkkonummi, Finland.

Kippel et al., "Loudspeaker Nonlinearities—Causes, Parameters, Symptoms", Apr. 17, 2007, Klippel GmbH, Dresden, Germany.

Dodd et al., "Voice Coil Impedance as a Function of Frequency and Displacement", Nov. 21, 2016, KEF Audio UK (Ltd), Maidstone, Kent, ME15 6QP United Kingdom.

* cited by examiner

REACTIVE SILENT SPEAKER DEVICE FOR SIMULATING HARMONIC NONLINEARITIES OF A LOUDSPEAKER

BACKGROUND

A loudspeaker may receive a signal from an amplifier, and may output the signal as audio/sound. However, the loudspeaker may introduce harmonic nonlinearities, that are not present in the original signal, when converting such signal to sound.

The loudspeaker contains at least one permanent magnet and a voice-coil that is located within a cylindrical "gap" in or near the permanent magnet. The input signal is, typically, passed by a power amplifier as a current into the voice-coil. The current causes the voice-coil to act as an electromagnet that creates a fluctuating magnetic field. The fluctuating magnetic field causes the electromagnet to attract and repel relative to the permanent magnet. A diaphragm or cone structure, that is connected to the voice-coil, amplifies the vibrations or movements of the electromagnet, thereby creating the sound.

Electrical and/or mechanical properties of the loudspeaker components may cause the output sound to be an inexact representation of the input signal. The differences in the input signal and the output sound are referred to as harmonic nonlinearities. The harmonic nonlinearities may include amplitude shifts, phase shifts, or new spectral components that were not present in the input signal. The harmonic nonlinearities may change one or more characteristics of the tone, attack, distortion, and/or other properties of the output sound relative to the input signal.

It is important to note that harmonic nonlinearities may change depending how hard the loudspeaker is driven. For instance, the loudspeaker may output sound with a first set of harmonic nonlinearities based on an input signal with a first amount of amplification, and may output sound with a different second set of harmonic nonlinearities based on the same input signal being provided with a different second amount of amplification.

Some musicians may prefer sound that includes the loudspeaker harmonic nonlinearities over an exact reproduction of the input signal. Accordingly, some musicians may record the loudspeaker output rather than the direct signal that is used to drive the loudspeaker (i.e., amplifier output). However, the primary method to capture the sound with the harmonic nonlinearities, that are introduced by a loudspeaker, is to place a studio-quality microphone, that is capable of withstanding the attendant sound pressure level ("SPL") and accurately reproducing the response of the loudspeaker, in front of the loudspeaker, and play a musical instrument at a volume that creates the desired harmonic nonlinearities (e.g., a volume and/or SPL levels in excess of 100 decibels at 1 meter). Such recording is impractical for musicians that record outside a sound-proof studio.

DETAILED DESCRIPTION OF PREFERRED EMBODIMENTS

The following detailed description refers to the accompanying drawings. The same reference numbers in different drawings may identify the same or similar elements.

Disclosed is a reactive silent speaker ("RSS") device for introducing harmonic nonlinearities of a loudspeaker to an input signal without outputting the input signal as audio or sound through a loudspeaker and recording the output audio or sound. The RSS device may match and/or replicate the different harmonic nonlinearities, including amplitude shifts, phase shifts, and/or new spectral components (e.g., distortion), that the loudspeaker imparts on an input signal across different levels of amplification (e.g., different volumes or gains). In other words, the RSS device may match the nonlinear relationship between the signal that is input to the loudspeaker and the captured signal (e.g., via a microphone or other audio sensor) for the sound output by the loudspeaker without using any speaker or output device, and without recording or capturing any audio or sound.

Like the loudspeaker, the RSS device is a passive device that functions without any external power or power supply. The RSS device may be connected to the output of an amplifier, and may receive an amplified signal from the amplifier as input. The RSS device may adjust and/or alter the amplified signal from the amplifier by changing one or more of the frequency response, distortion, tone, pitch, vibrato, attack and decay, and/or other harmonic properties of the signal at different frequencies, positions, or times to mirror the sound that would be output from a loudspeaker. However, instead of outputting the sound through a loudspeaker and recording the output sound to capture the adjusted harmonics, the RSS device may directly output a modified signal that includes the adjusted harmonics.

The modified signal from the RSS device may be divided down to line level, typically, 0 decibels ("dBu"), +/−10 dBu, and then provided directly to a mixing console or recording device. In this manner, the RSS device and mixing console or recording device may be used to directly record the same harmonic properties that would result from recording "live" loudspeaker output without having to output or play the sound through such loudspeaker. Moreover, the divided and/or modified signal from the RSS device output may be fed directly to a headphone amplifier so that a user can hear a reproduction of the loudspeaker harmonic nonlinearities via the headphones. In other words, the headphones may be used to monitor playback of the modified signal as provided, without relying on, or expecting the headphone drivers to impart the harmonic nonlinearities of the loudspeaker to the monitored audio signal.

Figure 1:
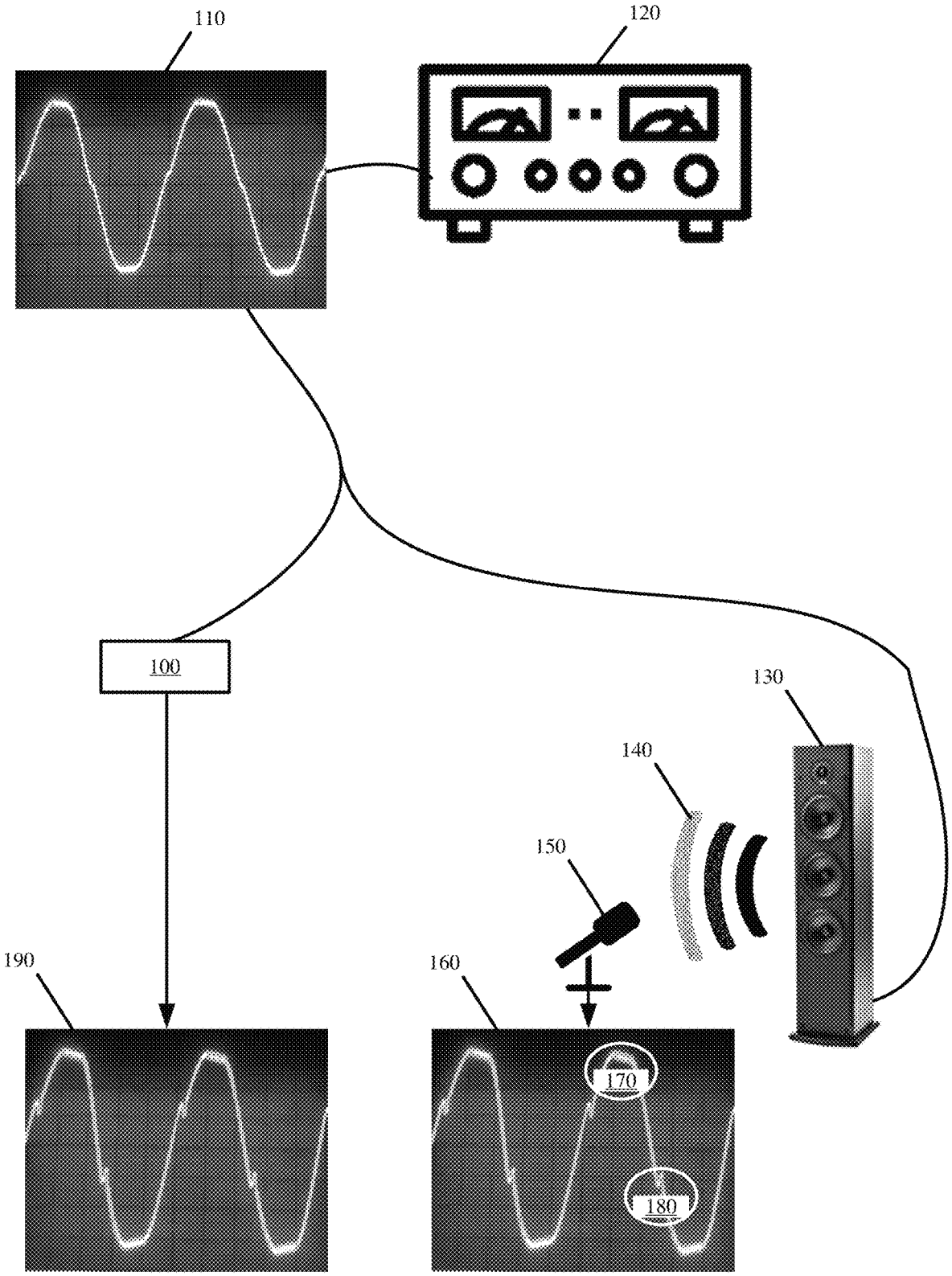
FIG. 1 illustrates an example of harmonic nonlinearities that are introduced by a reactive silent speaker ("RSS") device in accordance with some embodiments presented herein.

FIG. 1 illustrates an example of harmonic nonlinearities that are introduced by RSS device 100 in accordance with some embodiments presented herein. FIG. 1 illustrates amplified signal 110 being output from amplifier 120. In particular, a source signal may be used to drive input of amplifier 120, whose output (i.e., amplified signal 110), in turn, may drive loudspeaker 130 or RSS device 100.

Output 140 of loudspeaker 130 may be captured using microphone and/or other sound recording device 150. Recording device 150 may convert output 140 to output signal 160. As can be seen, output 140 and output signal 160 may have various harmonic nonlinearities that were not present in the source signal or amplified signal 110, and were introduced by loudspeaker 130. For instance, output signal 160 may include clipping 170 (e.g., squaring off of the signal peaks) and distortion 180 that were not present in the source signal or amplified signal 110.

RSS device 100 may adjust amplified signal 110 in a similar manner, thereby generating output signal 190 with harmonic nonlinearities that match or are similar to the harmonic nonlinearities found in output signal 160 captured by recording device 150 from output 140 of loudspeaker 130. Specifically, RSS device 100 may introduce the same or similar harmonic nonlinearities to amplified signal 110 as the loudspeaker 130 without outputting and/or converting amplified signal 110 to sound and recording the output sound.

RSS device 100 may produce the harmonic nonlinearities of loudspeaker 130 by recreating and/or simulating the electrical interactions within loudspeaker 130 that give rise to the harmonic nonlinearities. In some embodiments, RS S device 100 may recreate and/or simulate magnetic field interactions between the loudspeaker voice-coil (e.g., loudspeaker electromagnet) and the loudspeaker permanent magnet, nonlinearity of voice-coil inductance (e.g., the dependence of inductance on electric current and voice-coil positioning relative to the permanent magnet), and/or non-homogeneity of the magnetic flux density between the voice-coil and permanent magnet that are primarily responsible for creating the audio-frequency ("AF") harmonic nonlinearities (e.g., harmonic nonlinearities between 20 hertz ("Hz") to 20 KHz).

Research has found that the nonlinearity of the voice-coil is neglected in the low frequency range (e.g., below 20 Hz) because of the low value of the electrical impedance of the voice-coil when driven in the low frequency range. Although, harmonic nonlinearities at low frequencies may be caused by mechanical properties of the loudspeaker (e.g., loudspeaker diaphragm stiffness, suspension and displacement of the voice-coil, etc.), the low frequency harmonic nonlinearities are comparatively less significant in respect of overall sonic character and can be considered as having a more limited impact on the cumulative output sound. Research has found that the voice-coil inductance does however contribute significantly to the generation of higher frequency harmonic nonlinearities (e.g., harmonic nonlinearities that are introduced above 20 Hz). Such higher frequency harmonic nonlinearities are of significance and are largely emulated by RSS device 100.

Accordingly, RSS device 100 may recreate the desired harmonic nonlinearities by emulating and/or reproducing electrical and/or magnetic properties of loudspeaker 130. RSS device 100 may emulate and/or reproduce the electrical and/or magnetic properties of loudspeaker 130 using a set of silent and passive components that differ from the set of loudspeaker components responsible for creating the harmonic nonlinearities, and using a unique arrangement of the components that is not present in loudspeaker 130. Nevertheless, the set of silent and passive components of RSS device 100 may produce the same or similar magnetic field interactions that recreate the harmonic nonlinearities of loudspeaker 130 at different operating ranges.

Figure 2:
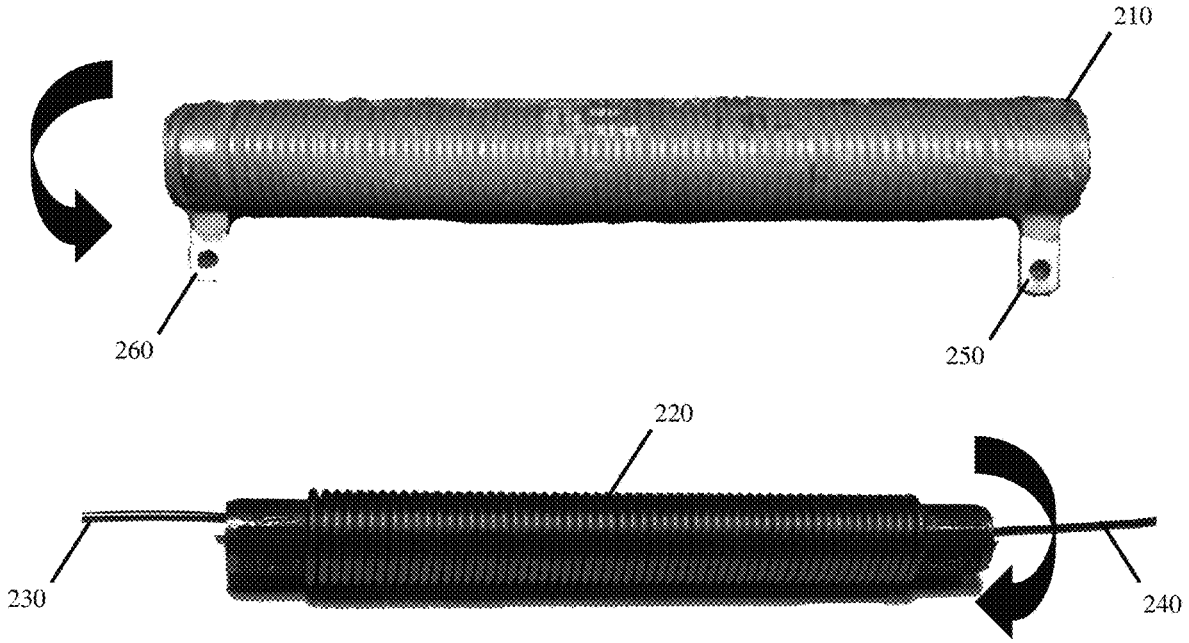
FIG. 2 illustrates an exploded view of the primary components of the RSS device in accordance with some embodiments presented herein.
Figure 3:
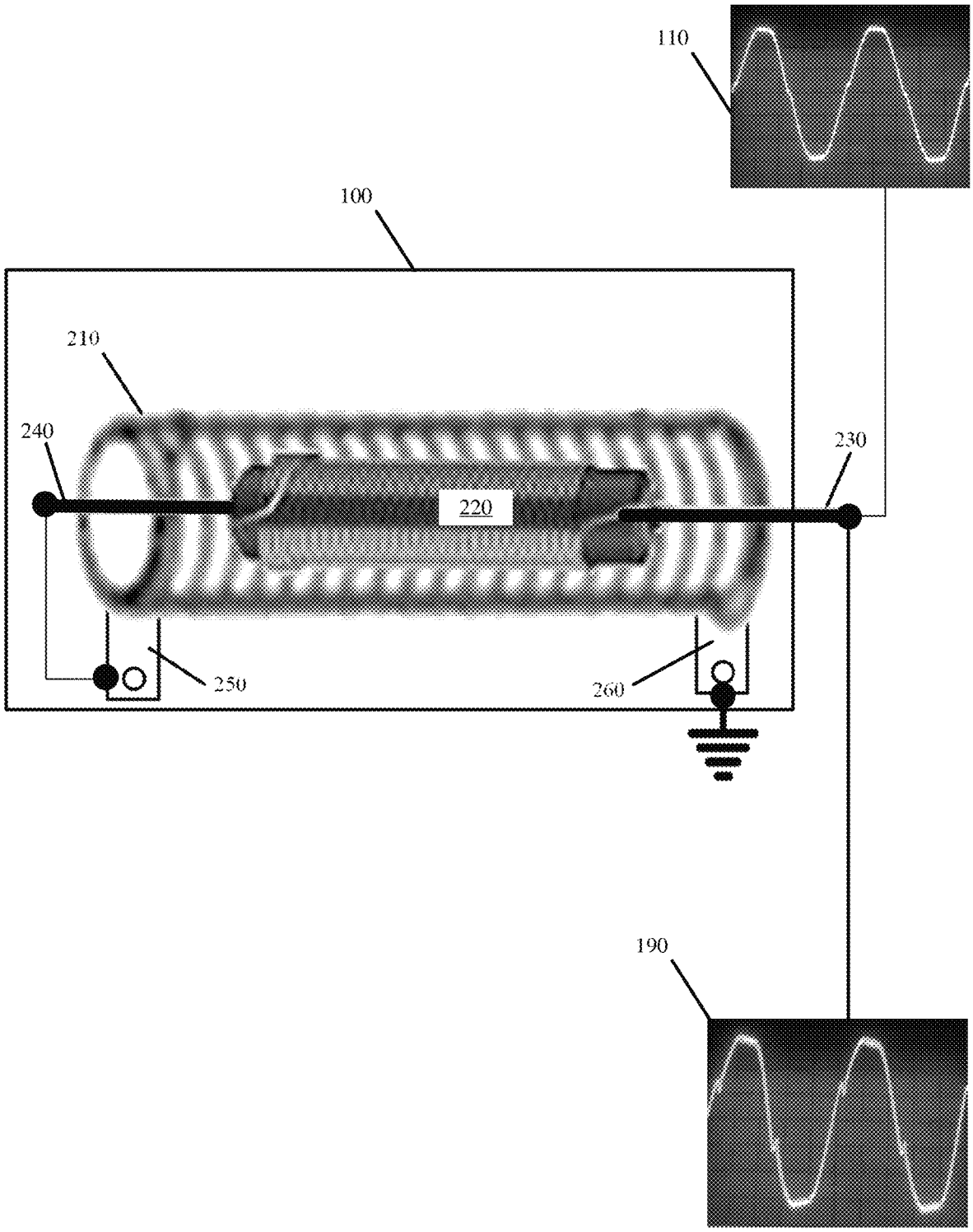
FIG. 3 illustrates a connected view of the primary components of the RSS device in accordance with some embodiments presented herein.

FIG. 2 illustrates an exploded view of the primary components of RSS device 100 for silent generation of loudspeaker harmonic nonlinearities in accordance with some embodiments presented herein. FIG. 3 illustrates a connected view of the primary components of RSS device 100 in accordance with some embodiments presented herein. As shown in FIGS. 2 and 3, RSS device 100 may be comprised of a resistive element 210 and inductive element 220.

In some embodiments, resistive element 210 may include a tubular wire-wound resistor with a hollow core. The tubular wire-wound resistor may include an insulated metallic wire that is wound around a hollow core in a first direction (e.g., clockwise winding).

The hollow core may be made of ceramic, plastic, glass, wood, and/or another non-conductive material. Alternatively, the hollow core may be made of metal and/or another conductive material, insulated from the coil winding.

The insulated metallic wire may have high resistivity, and may be made of an alloy (e.g., a copper alloy, silver alloy, nickel chromium alloy, iron chromium alloy, etc.). The insulated metallic wire may be wound around the core using Ayrton-Perry winding or another winding.

Resistive element 210 may have a particular length that, together with properties of the selected wire and hollow core, define the electrical properties of resistive element 210. In illustrative embodiments, resistive element 210 may provide 8 ohms of resistance, a power rating of 100 watts, 5% tolerance, and an inductance of 17 microhenries ("uH"). In some other embodiments, these properties may change by changing the length of the hollow core, the length of wiring, the diameter and/or resistivity of the wiring, and/or materials of the wiring and/or core. For instance, RSS device 100 may match or replicate the same harmonic nonlinearities of a particular loudspeaker with a resistive element 210 having a length between 1 and 20 inches, 2 to 16 ohms of resistance, a power rating between 25 and 150 watts, 1% to 10% tolerance, and/or inductance between 10-100 uH.

Inductive element 220 may include a wire-wound inductor with a metal-based core that is wrapped around (e.g., wound) with wiring in a second direction (e.g., counter-clockwise winding) that is opposite to the winding of the wire of resistive element 210. In some embodiments, inductive element 220 may include copper magnet wire. The metal-based core may be ferrous in composition, such as common iron rod-stock. Said core may be 2 to 8 inches in length and may be 0.1 to 1 inch thick. Specifically, said core may be sized to fit entirely within the hollow core of resistive element 210. The magnet wire employed for the coil winding may employ single, or multiple build, synthetic insulation, such as polyurethane, enamel, or Formvar.

Some embodiments may vary the size and composition of the core, the length of wiring (e.g., the number of turns around the core), the diameter and/or resistivity of the wiring, and/or materials of the wiring and/or core in order to alter the properties of inductive element 220. For instance, in some embodiments, inductive element 220 may include a 4.75 inch by 0.38 inch iron rod-stock core and 58 turns of 16-gauge copper magnet wire to yield a wire-wound inductor with 65.7 uH of inductance. In some other embodiments, inductive element 220 may include a 6.5 inch by 0.38 inch iron rod-stock core and 124 turns of 16-gauge copper magnet wire to yield a wire-wound inductor with 170 uH of inductance. In some other embodiments, inductive element 220 may include a permanent magnet rod for the core, or a core comprised of different iron or metallic alloys and/or other materials (e.g., AlNiCo composed of aluminum ("Al"), nickel ("Ni"), and cobalt ("Co")), ferrite, ferrite-ceramic , neodymium, samarium-cobalt, and/or other materials.

As shown in FIG. 3, inductive element 220 may be inserted into the hollow core of resistive element 210 with the wire of inductive element 220 wound in a reverse direction to the wire of resistive element 210. In some embodiments, inductive element 220 may rest inside the hollow core about the bottom side of the hollow core. In some such embodiments, inductive element 220 may be affixed to the hollow core using an adhesive or may be held in place via brackets (not shown) on either side of resistive element 210 that prevent inductive element 220 from falling out or moving within the hollow core. In some other embodiments, brackets (not shown) may be attached to either side of resistive element 210, and may be used to suspend inductive element 220 centrally within the hollow core of resistive element 210.

Inductive element 220 may be connected in series to resistive element 210. In particular, inductive element 220 may include input/output terminal 230 at one end of the inductive element wire. Input/output terminal 230 may be connected to a level-attenuated line-out port of RSS device 100 and/or a wire connection that feeds an amplified signal from an amplifier or other source device directly into RSS device 100. Accordingly, RSS device 100 may be a stand-alone device or a device that is integrated within an amplifier or other audio equipment. Inductive element 220 may also include coupling terminal 240 at an end of the inductive element wire that is opposite to input/output terminal 230. Coupling terminal 240 may be connected to input terminal 250 of resistive element 210. Accordingly, the current associated with the input signal flows in one direction through inductive element 220 and in an opposite direction through resistive element 210 due to the wire of inductive element 220 being wound in an opposite direction relative to the wire of resistive element 210.

Ground terminal 260 of resistive element 210 may be connected to chassis or other system grounding point to complete the circuit. A line-out port of RSS device 100 may feed a recording device, headphone amplifier, monitor speaker, or any other device where the adjusted signal with the harmonic nonlinearities is desired. Consequently, the signal with the harmonic nonlinearities may be output from input/output terminal 230 of inductive element 220 and may be directly recorded, with appropriate attenuation, without being output through loudspeaker 130 and/or without the input signal, lacking the harmonic nonlinearities, or the output signal, that is modified to include the harmonic nonlinearities, being output as audio or sound.

RSS device 100 may have alternative placement and/or wiring for inductive element 220 and/or resistive element 210, and still produce the adjusted harmonics. For instance, when inductive element 220 is inserted into resistive element 210 with the wiring of inductive element 220 being in the same direction as the wiring of resistive element 210, input/output terminal 250 of resistive element 210 may be placed on the side that is opposite to the side at which coupling terminal 240 of inductive element 220 is located. In other words, coupling terminal 240 about a right side of inductive element 220 may be connected to input terminal 250 about a left side of resistive element 210 when the wires of resistive element 210 and inductive element 220 are wound or oriented in the same direction in order to preserve the opposite directional flow of current through inductive element 220 and resistive element 210, wherein the opposite direction flow of current creates the magnetic field fluctuations within RSS device 100 that introduce the loudspeaker harmonic nonlinearities to the input signal.

Another alternative configuration may include providing the input or amplified signal to input/output terminal 250 of resistive element 210 instead of input/output terminal 230 of inductive element 220. In this alternate configuration and so long as the wiring phase between resistive element 210 and inductive element 220 is observed, RSS device 100 may introduce the same harmonic nonlinearities to the signal. In some such embodiments, a first terminal of resistive element 210 may receive the input or amplified signal, an opposite second terminal of resistive element 210 may be connected in series to a first terminal of inductive element 220, and the output signal with the introduced harmonic nonlinearities may be observed at the first terminal of resistive element 210. The second terminal of inductive element 220 may be connected to ground.

RSS device 100 may include resistive element 210 and/or inductive element 220 with different properties (e.g., different physical dimensions and/or different electrical properties) in order to mirror and/or replicate the harmonic nonlinearities created by loudspeakers of different manufacturers, loudspeakers with different components, and/or loudspeakers with different desired sound characteristics. For instance, a first RSS device 100 with a first resistive element 210, that is 4 inches in length, provides 8 ohms of resistance, a power rating of 100 watts, 5% tolerance, and an inductance of 17 uH, and a first inductive element 220, that is 2 inches in length, has 40 turns of 14-gauge copper magnet wire, and has 35 uH of inductance, may be used to mirror and/or replicate the harmonic nonlinearities of a first loudspeaker, whereas a different second RSS device 100 with a second resistive element 210, that is 8 inches in length, provides 16 ohms of resistance, a power rating of 100 watts, 410% tolerance, and an inductance of 25 uH, and a second inductive element 220, that is 4 inches in length, has 60 turns of 16-gauge copper magnet wire, and has 60 uH of inductance, may be used to mirror and/or replicate the harmonic nonlinearities of a different second loudspeaker.

Figure 4:
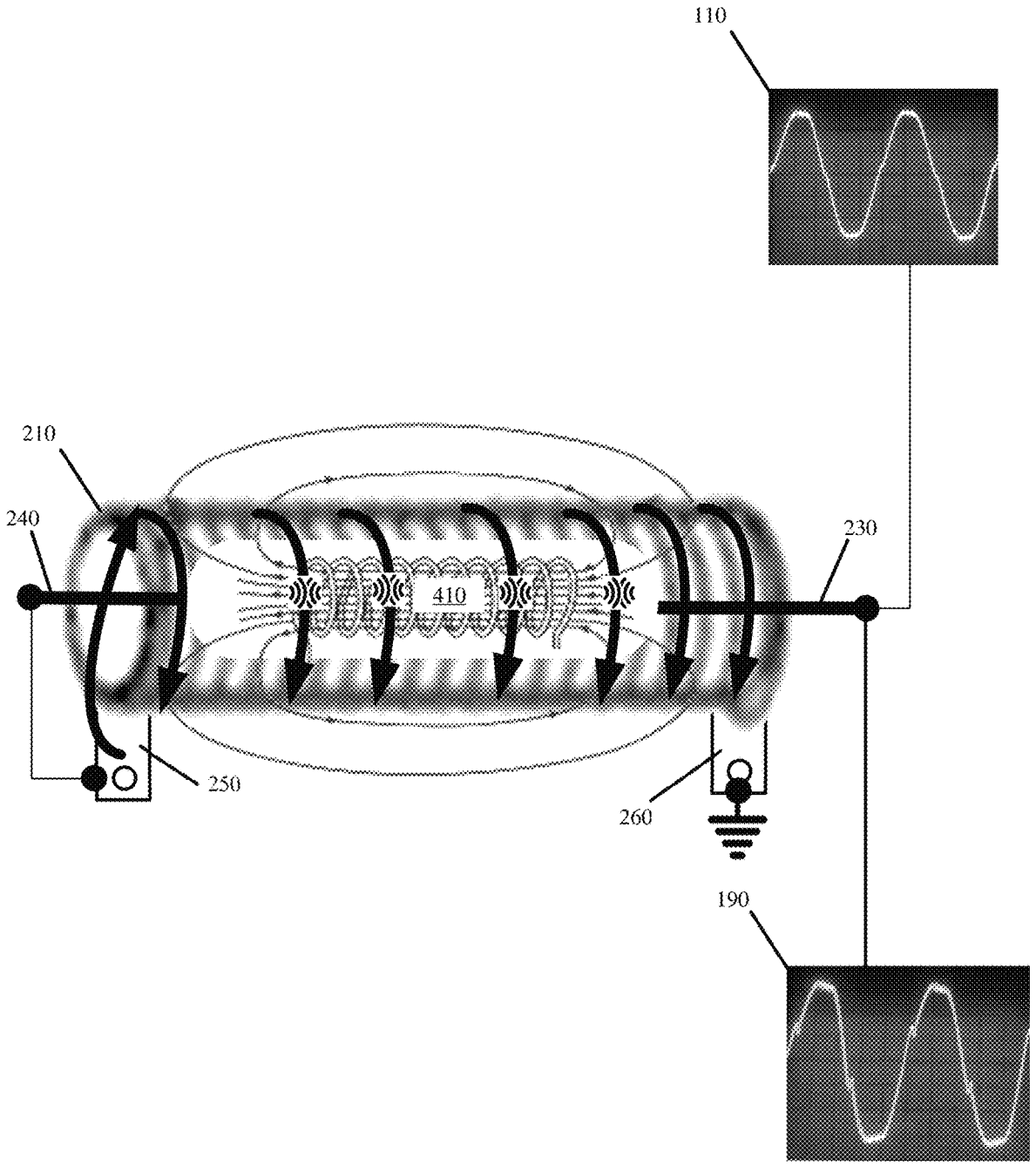
FIG. 4 provides an illustration for replicating loudspeaker harmonic nonlinearities using the RSS device in accordance with some embodiments presented herein.

FIG. 4 provides an illustration for replicating loudspeaker harmonic nonlinearities using RSS device 100 in accordance with some embodiments presented herein. Inductive element 220 of RSS device 100 may simulate the loudspeaker voice-coil. In particular, when an input signal (e.g., amplified signal output from an amplifier) is passed to input/output terminal 230 of inductive element 220, inductive element 220 may become an electromagnetic similar to the loudspeaker voice-coil, and may create fluctuating magnetic field 410 within resistive element 210.

Strength of magnetic field 410 may correspond to the amount of amplification applied to the input signal. For instance, the greater the amplification (e.g., more current, higher frequency, etc.), the greater the strength of magnetic field 410. Magnetic field 410 may also fluctuate in phase with the signal. For instance, when the angle of a sinusoidal waveform, representative of the signal, is equal to 0, 180, or 360 degrees, the strength of magnetic field 410 is 0. The strength of magnetic field 410 with a first polarity is greatest when the angle of the sinusoidal waveform is 90 degrees, and the strength of magnetic field 410 with an opposite second polarity is greatest when the angle of the sinusoidal waveform is 270 degrees.

Resistive element 210 may replicate the resistance and/or impedance of the loudspeaker voice-coil, and the current within resistive element 210 may be affected by changing magnetic field 410 when magnetic field 410 increases in strength to penetrate resistive element 210. In some embodiments, magnetic field 410 may create an electromotive force ("EMF") that is counter to the flow of current through resistive element 210 as a result of the wiring of resistive element 210 and inductive element 220 being wound in opposite directions and the wiring of resistive element 210 falling within magnetic field 410 created by inductive element 220. In some embodiments, the induced current or EMF may depend on the area of the coil for inductive element 220 (e.g., proportional to the number of windings in the coil) and/or the change in magnetic field 410.

As magnetic field 410 increases in strength, it will have an increasing effect on the signal or current passing through resistive element 210. The distortion generated from the electromagnetic interplay between magnetic field 410 and resistive element 210 may correspond to the harmonic nonlinearities found in loudspeaker output. For instance, loudspeaker nonlinearities may be dependent on increases to the amplified signal frequency and/or amplitude. These same increases to the amplified signal frequency and/or amplitude may increase the strength of magnetic field 410 to create nonlinearities, that are proportional to those created by the loudspeaker voice-coil, on the signal at input/output port 230.

More specifically, the inductance or EMF may arise from Faraday's law which states the EMF induced in a loop of wire (e.g., inductive element 220) equals the rate of change of the magnetic flux flowing through the loop. The inductance or EMF may therefore be directly proportional to the changing frequency of the input signal. The EMF then appears in series with the resistance of resistive element 210, due to positioning and series connectivity between resistive element 210 and inductive element 220, and may introduce nonlinearity in the relationship between the voltage and current. This nonlinearity in the relationship between the voltage and current may produce the harmonic nonlinearities in the signal being output from RSS device 100. For instance, passing the signal through resistive element 210 while resistive element 210 is within fluctuating magnetic field 410 of inductive element 220 can create force factor variation that causes fluctuation in impedance angle, and hence phase modulation of current at middle frequencies, position-dependent inductance that causes both amplitude and phase modulation in the current, and/or current-dependence that causes odd-order nonlinearity. Consequently, RSS device 100 may be able to reproduce many of the significant nonlinearities of the loudspeaker at the same ranges, frequencies, and/or amplitudes without requiring the physical displacement of a voice-coil and/or diaphragm relative to a permanent magnet.

Figure 5:
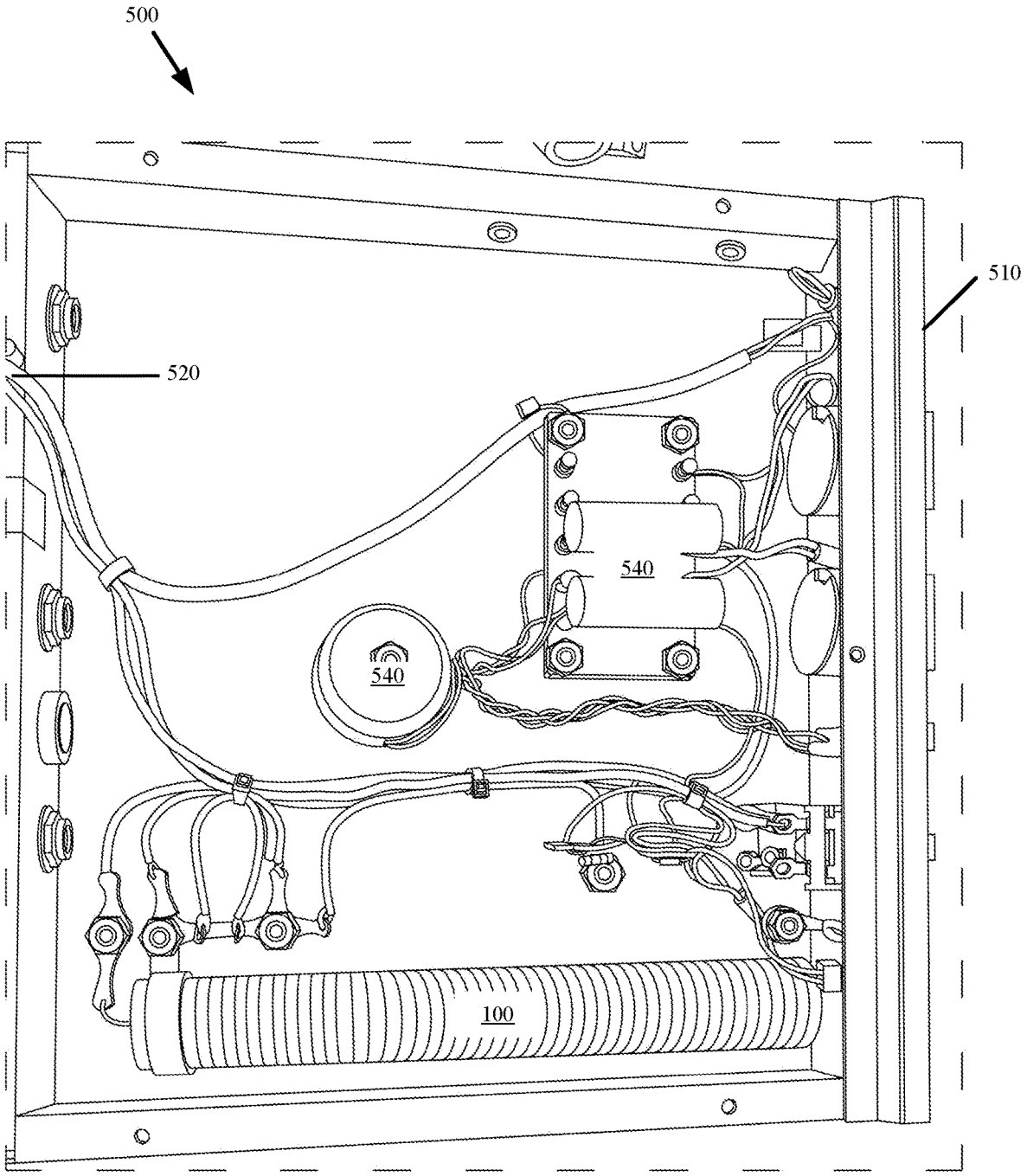
FIG. 5 illustrates a top view for an apparatus containing the RSS device in accordance with some embodiments presented herein.
Figure 6:
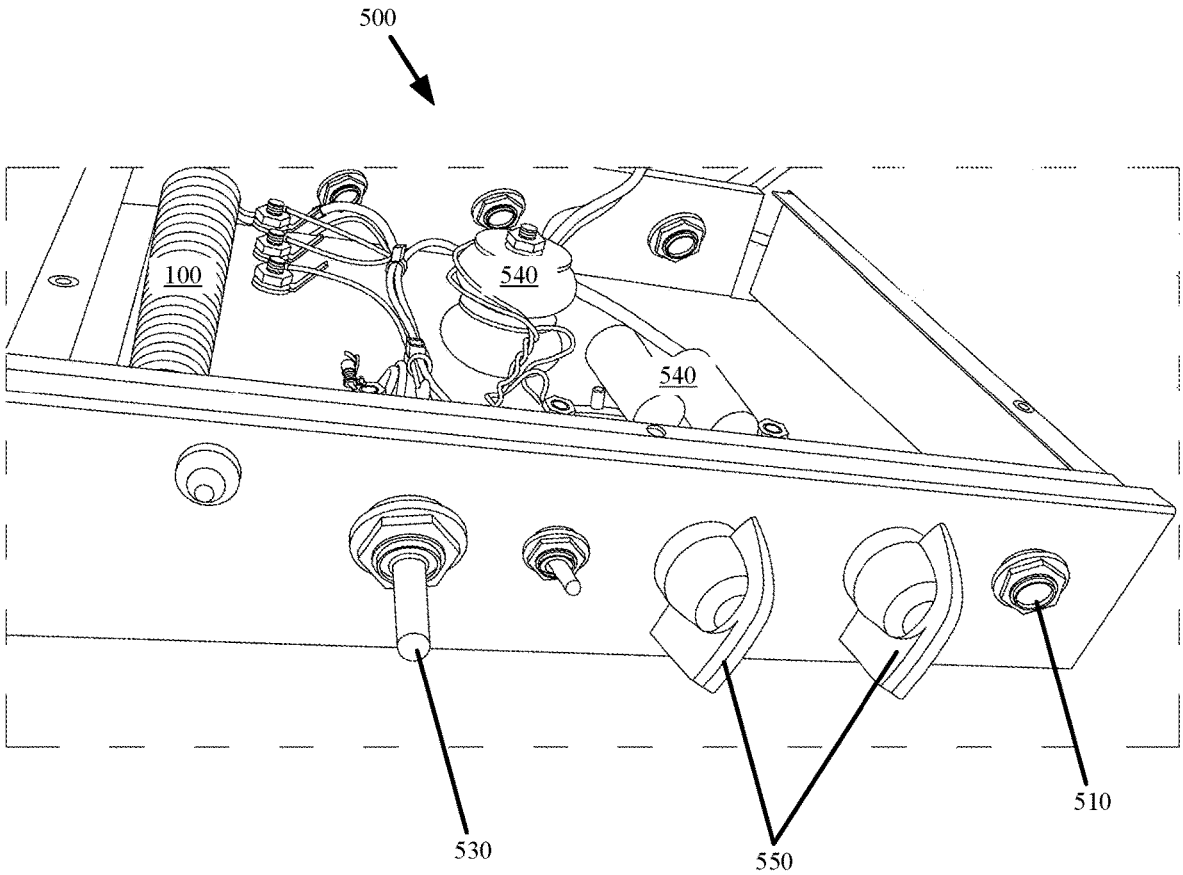
FIG. 6 illustrates a perspective front view of the apparatus in accordance with some embodiments.

FIG. 5 illustrates a top view for apparatus 500 containing RSS device 100 in accordance with some embodiments presented herein. FIG. 6 illustrates a perspective front view of apparatus 500 in accordance with some embodiments.

Apparatus 500 may provide a box or other fixture for containing RSS device 100. RSS device 100 may be located about one side of apparatus 500 with inductive element 220 inserted inside resistive element 210, with the components connected in series, and with wiring of the inductive element 220 being in an opposite direction to the wiring of resistive element 210. Moreover, apparatus 500 may provide at least amplifier-in port 510, line-out port 520, and switch 530.

Amplifier-in port 510 may receive amplifier output and/or an input signal that will subsequently include the loudspeaker harmonic nonlinearities. Amplifier-in port 510 may connect to switch 530.

Switch 530 may provide a toggle for manually redirecting the input signal through RSS device 100 or for bypassing RSS device 100. For instance, when switch 530 is set at a first position (e.g., down), the input signal flows along a first wire path to input/output terminal 230 of inductive element 220, and RSS device 100 introduces the harmonic nonlinearities into the signal. When switch 530 is set at a different second position (e.g., up), the input signal bypasses RSS device 100 and no harmonic nonlinearities are introduced by RSS device 100 into the signal. In this configuration, switch 530 may route the amplifier signal to a loudspeaker, if desired, which, effectively, maintains the nonlinear sonic characteristics of the line-level signal tap (e.g., signal being input apparatus 500), while allowing for audible audio output and bypassing of RSS device 100. Switch 530 may be used to redirect amplifier output signal to a loudspeaker or other load device.

Line-out circuitry 540 may be used to process the input signal sourced from input/output terminal 230 from RSS device 100, or the signal routed to an external speaker or load device by switch 530. Line-out circuitry 540 may include one or more inductors, capacitors, resistors, switches, and/or other electrical components with which input signal frequencies and/or other properties of the input signal may be tuned. Dials 550 at the front of apparatus 500 may control the frequency tuning and line-out level.

Line-out port 520 may receive output from line-out circuitry 540. Line-out port 520 may be connected to a monitor speaker, headphone amplifier, recording console or other line-level audio input device.

The foregoing description of implementations provides illustration and description, but is not intended to be exhaustive or to limit the possible implementations to the precise form disclosed. Modifications and variations are possible in light of the above disclosure or may be acquired from practice of the implementations. Moreover, even though particular combinations of features are recited in the claims and/or disclosed in the specification, these combinations are not intended to limit the disclosure of the possible implementations. In fact, many of these features may be combined in ways not specifically recited in the claims and/or disclosed in the specification. Although each dependent claim listed below may directly depend on only one other claim, the disclosure of the possible implementations includes each dependent claim in combination with every other claim in the claim set.

Some implementations described herein may be described in conjunction with thresholds. The term "greater than" (or similar teens), as used herein to describe a relationship of a value to a threshold, may be used interchangeably with the term "greater than or equal to" (or similar f n Similarly, the term "less than" (or similar terms), as used herein to describe a relationship of a value to a threshold, may be used interchangeably with the term "less than or equal to" (or similar terms). As used herein, "exceeding" threshold (or similar terms) may be used interchangeably with "being greater than a threshold," "being greater than equal to a threshold," "being less than a threshold," "being less than or equal to a threshold," or other similar terms, depending on the context in which the threshold is used.

No element, act, or instruction used in the present application should be construed as critical or essential unless explicitly described as such. An instance of the use of the term "and," as used herein, does not necessarily preclude the interpretation that the phrase "and/or" was intended in that instance. Similarly, an instance of the use of the term "or," as used herein, does not necessarily preclude the interpretation that the phrase "and/or" was intended in that instance. Also, as used herein, the article "a" is intended to include one or more items, and may be used interchangeably with the phrase "one or more." Where only one item is intended, the terms "one," "single," "only," or similar language is used. Further, the phrase "based on" is intended to mean "based, at least in part, on" unless explicitly stated otherwise.

What is claimed is:

1. An apparatus comprising:

a resistive element comprising:

a rigid outer core with a hollow and empty central cavity;

a first wire that is wound around the rigid outer core in a first direction;

a terminal at a first end of the first wire;

a grounded second end of the first wire; and an inductive element inserted within the hollow and empty central cavity of the the rigid outer core without a top of the inductive element contacting any part of the rigid outer core or the resistive element, the inductive element comprising:

a metal-based core;

a second wire that is wound around the metal-based core in a second direction that is opposite to the first direction;

a first terminal at a first end of the second wire;

a second terminal at an opposite second end of the second wire; and wherein the second terminal of the inductive element is connected in series to the terminal of the resistive element, wherein the resistive element and the inductive element generate electromagnetic distortion in response to a signal on the first terminal, and wherein the electromagnetic distortion alters the signal to include harmonic nonlinearities.

2. The apparatus of claim 1, wherein the rigid outer core is made of a non-conductive material.

3. The apparatus of claim 2, wherein the non-conductive material comprises at least one of ceramic, plastic, or glass.

4. The apparatus of claim 1, wherein the inductive element is an electromagnet that generates a fluctuating magnetic field in response to the signal passing through the second wire around the metal-based core.

5. The apparatus of claim 4, wherein the electromagnetic distortion replicates voice-coil inductance of a loudspeaker, and the replicated voice-coil inductance is a source for the harmonic nonlinearities introduced into the signal.

6. The apparatus of claim 4, wherein inductance of the fluctuating magnetic field produces the harmonic nonlinearities.

7. The apparatus of claim 1, wherein a length of the rigid outer core is longer than a length of the metal-based core.

8. The apparatus of claim 7 further comprising a line-out port configured to output the signal with the harmonic nonlinearities to a monitor loudspeaker, headphone amplifier, or recording device.

9. The apparatus of claim 1 further comprising an amplifier-in port configured to receive the signal from an external device.

10. The apparatus of claim 9 further comprising a switch that connects to the first terminal of the inductive element when at a first position, and that bypasses the inductive element and the resistive element when at a different second position.

11. The apparatus of claim 1, wherein the resistive element comprises a wire-wound resistor with inductance less than 30 microhenries ("uH"), and wherein the inductive element comprises a wire-wound inductor with inductance greater than 50 uH.

12. The apparatus of claim 1, wherein the inductive element rests inside and against a bottom of the rigid outer core.

13. The apparatus of claim 1 further comprising a pair of brackets attached to opposite ends of the inductive element, the pair of brackets suspending the inductive element centrally within the rigid outer core.

14. The apparatus of claim 1, wherein the harmonic nonlinearities mirror nonlinearities in audio output of a loudspeaker that is driven with the signal.

15. The apparatus of claim 1, wherein the harmonic nonlinearities comprise one or more of an amplitude shift, a phase shift, or a new spectral component that did not exist in the signal.

16. The apparatus of claim 1, wherein the harmonic nonlinearities comprise distortion that is added to the signal.

17. An apparatus comprising:

a resistive element comprising:

a tubular core with a hollow central cavity;

a first wire that is wound around the hollow core in a first direction;

a first terminal at a first end of the first wire;

a second terminal at an opposite second end of the second wire; and an inductive element inserted within the tubular core of the resistive element, the inductive element comprising:

a metal-based core;

a second wire that is wound around the metal-based core in a second direction that is opposite to the first direction;

a first terminal at a first end of the second wire;

a second terminal at an opposite second end of the second wire; and wherein the second terminal of the inductive element is connected in series to the first terminal of the resistive element, wherein the resistive element and the inductive element generate electromagnetic distortion in response to a signal received on the second terminal or the first terminal of the resistive element, and wherein the electromagnetic distortion alters the signal to include harmonic nonlinearities.

18. A method comprising:

disposing a wire-wound inductor inside a hollow central cavity of a tubular core wire-wound resistor with wiring of the wire-wound inductor being in an opposite direction to wiring of the tubular core wire-wound resistor;

connecting a first terminal of the wire-wound inductor in series to a terminal of the tubular core wire-wound resistor;

providing a signal to a second input terminal of the wire-wound inductor;

generating electromagnetic distortion from a fluctuating magnetic field, that is created as a result of the signal passing through the wire-wound inductor, penetrating the tubular core wire-wound resistor;

introducing harmonic nonlinearities into the signal based on the electromagnetic distortion; and outputting the signal with the harmonic nonlinearities.

19. The method of claim 18, wherein introducing the harmonic nonlinearities comprises:

altering a flow of current based on inductance of the fluctuating magnetic field.

20. The method of claim 18, wherein the harmonic nonlinearities comprise one or more of an amplitude shift, a phase shift, or a new spectral component that did not exist in the signal.

* * * * *